US012196042B1

(12) United States Patent
Lin et al.

(10) Patent No.: US 12,196,042 B1
(45) Date of Patent: Jan. 14, 2025

(54) WEAR-RESISTANT AND COLLISION-RESISTANT POLYCRYSTALLINE DIAMOND COMPACT (PDC) DRILL BIT WITH ROSTRIFORM TEETH AND PLURALITY OF BLADES

(71) Applicant: Southwest Petroleum University, Sichuan (CN)

(72) Inventors: Tiejun Lin, Sichuan (CN); Chengsong Yang, Sichuan (CN); Hao Yu, Sichuan (CN); Jianhua Guo, Sichuan (CN); Jiachang Nie, Sichuan (CN); Chengxiu Yu, Sichuan (CN); Yuheng Tuo, Sichuan (CN); Hao Han, Sichuan (CN); Xin Zeng, Sichuan (CN); Zelin Zhu, Sichuan (CN); Ruiqi Shen, Sichuan (CN); Wenle Yu, Sichuan (CN); Zeqian Ren, Sichuan (CN)

(73) Assignee: Southwest Petroleum University, Chengdu (CN)

( * ) Notice: Subject to any disclaimer, the term of this patent is extended or adjusted under 35 U.S.C. 154(b) by 0 days.

(21) Appl. No.: 18/402,298

(22) Filed: Jan. 2, 2024

(30) Foreign Application Priority Data

Jun. 30, 2023 (CN) ..... 202310786831.5

(51) Int. Cl.
*E21B 10/56* (2006.01)
*E21B 10/567* (2006.01)

(52) U.S. Cl.
CPC ..... *E21B 10/5671* (2020.05)

(58) Field of Classification Search
CPC .. E21B 10/43; E21B 10/5671; E21B 10/5673; E21B 10/602
See application file for complete search history.

(56) References Cited

U.S. PATENT DOCUMENTS

2008/0302575 A1* 12/2008 Durairajan ..... E21B 10/43 175/327
2015/0308197 A1* 10/2015 Scott ..... E21B 10/46 175/430
2015/0368977 A1* 12/2015 Yang ..... E21B 10/43 175/336
2016/0376845 A1* 12/2016 Chen ..... G06F 30/20 175/57

(Continued)

FOREIGN PATENT DOCUMENTS

CN 108194026 A 6/2018
CN 109707316 A 5/2019
CN 110439470 A 11/2019

*Primary Examiner* — Cathleen R Hutchins

(57) ABSTRACT

Provided is a novel wear-resistant and collision-resistant polycrystalline diamond compact (PDC) drill bit with rostriform teeth and a plurality of blades, including an upper joint and a drill matrix. The PDC drill bit with rostriform teeth and a plurality of blades breaks rocks jointly by the primary teeth by way of penetration-splitting and the secondary teeth by way of shearing, so that the torque needed to break the rocks is greatly reduced. The design of the plurality of blades balances force distribution between rocks and blades at a shaft bottom, so that the abrasion loss of the teeth within a unit time is reduced. The present invention solves the technical problems in the prior art that cutting positions are abraded, and the teeth are fed slowly and are unreasonably distributed.

5 Claims, 5 Drawing Sheets

(56) References Cited

U.S. PATENT DOCUMENTS

| | | | | |
|---|---|---|---|---|
| 2019/0010764 | A1* | 1/2019 | Lyons | E21B 10/627 |
| 2019/0338599 | A1* | 11/2019 | Bellin | E21B 10/55 |
| 2020/0087992 | A1* | 3/2020 | Bellin | E21B 10/58 |

* cited by examiner

WEAR-RESISTANT AND COLLISION-RESISTANT POLYCRYSTALLINE DIAMOND COMPACT (PDC) DRILL BIT WITH ROSTRIFORM TEETH AND PLURALITY OF BLADES

CROSS-REFERENCE TO RELATED APPLICATION

This application claims priority from the Chinese patent application 202310786831.5 filed Jun. 30, 2023, the content of which is incorporated herein in the entirety by reference.

TECHNICAL FIELD

The present invention relates to the field of petroleum drilling, and particularly relates to a novel wear-resistant and collision-resistant polycrystalline diamond compact (PDC) drill bit with rostriform teeth and a plurality of blades.

BACKGROUND

A drill bit is tool for breaking rocks to form boreholes in petroleum drilling. Drill bits frequently used in petroleum drilling mainly include impregnated diamond bits, drag bits, roller bits, and polycrystalline diamond compact drill bits. A polycrystalline diamond compact is formed by compounding a polycrystalline diamond layer and a matrix. Thanks to excellent mechanical and chemical properties such as high strength, good toughness and good corrosion resistance, the polycrystalline diamond compact (also called a PDC tooth, a compact, a cutting tooth or a tooth) is widely used to manufacture superhard cutting tools, geological deep wells and space drill bits.

With the continuous progress of a cutting tooth material technology and a drill bit technology, the PDC drill bit has an increasingly wide stratum application range in oil and gas drilling engineering owning to its unique drilling safety, flexibility of structural form, and efficient cuttability to shear and break rocks. According to the statistics, 70% of total footage drilled worldwide is accomplished by the PDC drill bit nowadays, so that the PDC drill bit occupies an absolute dominant position. The range of application of the PDC drill bit is gradually expanded from soft and medium formations to hard grounds and complicated formations containing interlayers and gravels.

However, a conventional PDC drill bit is small in drilling footage and short in service life for the current complicated formations hard to drill, so that a tripping operation is frequently carried out, which severely affects the drilling period. At present, the conventional PDC drill bit enhances the agressivity of the drill bit. The PDC drill bit usually has 5-6 blades and double rows of teeth, with a single tooth form and simple tooth distribution. A drill bit body is not wear-resistant, so that the drill bit is extremely easily damaged and reduced.

SUMMARY

An object of the present invention is to provide a novel wear-resistant and collision-resistant polycrystalline diamond compact (PDC) drill bit with rostriform teeth and a plurality of blades, to solve the technical problems in the prior art that cutting positions are abraded, and the teeth are fed slowly and are unreasonably distributed.

To achieve the above object, the present invention provides a novel wear-resistant and collision-resistant polycrystalline diamond compact (PDC) drill bit with rostriform teeth and a plurality of blades, including an upper joint, a drill matrix, primary blades, secondary blades, and short blades, where the upper joint is connected to the drill matrix through threads; the drill matrix is of a nine-blade structure; the plurality of primary blades, secondary blades, and short blades are uniformly distributed on the drill matrix; the plurality of primary blades, secondary blades, and short blades are uniformly arranged at an interval of 40° in a circumferential direction on the drill matrix; a plurality of cutting tooth structures are arranged on the primary blades, secondary blades, and short blades; each of the primary blades is of a linear structure, and the primary blade is perpendicular to a normal plane of the drill matrix; each of the secondary blades and short blades is of a microspiral structure; a chip space is arranged between adjacent blades of the drill matrix; and the drill matrix is internally provided with a drilling fluid flow channel and water hole channels.

Further, the structure of each of the primary blades, secondary blades, and short blades is divided into a gauge protection end and a cutting blade; the gauge protection end is arranged at an upper end of the cutting blade and is an end close to the upper joint, guaranteeing a diameter dimension of a shaft wall and the smooth shaft wall; the gauge protection end is provided with an anti-jamming tooth and a gauge tooth; and the cutting blade of the drill bit is divided into a first cutting area, a second cutting area, and a third cutting area; the drill matrix includes the first cutting area, the second cutting area, and the third cutting area in sequence from an edge to a center; the first cutting area is responsible for breaking rocks at the center of the drill bit, and a reverse tapered tooth, a PDC primary tooth, and a PDC secondary tooth are placed in the first cutting area; the second cutting area is a major cutting area of the drill bit and is responsible for drilling and breaking new rock strata, and a rostriform PDC primary tooth and a PDC secondary tooth are placed in the second cutting area; and the third cutting area is a diameter expanding area responsible for expanding the diameter of a borehole, and a PDC primary tooth and an alloy tooth are placed in the third cutting area.

Further, the drill matrix is designed in the nine-blade structure; the rostriform PDC primary teeth of the nine-blade structure are placed in different circumferences, and the rostriform PDC primary teeth among the primary blades, secondary blades, and short blades are distributed in a staggered manner, so that the rostriform PDC primary teeth in the second cutting area are uniformly distributed, thereby increasing the utilization ratio of the rostriform PDC primary teeth and improving the rock breaking efficiency of the drill bit; a height difference is arranged between the teeth in front and back rows of the second cutting area, a height difference is also arranged between the teeth in the same row, the height differences are 0.5-1 mm, and tine angles between the teeth placed in the front and back rows and the stratum are 8-10°; and a one-time penetration of the drill bit is reduced by arranging the reasonable height differences and tine angles to prevent the teeth from being disintegrated and falling off, so that the service life of the drill bit is prolonged.

Further, the rostriform PDC primary tooth includes a PDC rostriform compact and a sphero-cylindrical alloy base, the PDC rostriform compact is of a cylindrical rostriform structure, and the sphero-cylindrical alloy base is of a cylindrical semi-spherical structure; one end of the sphero-cylindrical alloy base is provided with a stepped first surface, the PDC rostriform compact is provided with a stepped second surface contrary to the first surface, and the second surface is matched with the first surface; and the stepped design partially increases the thickness of a cutting part of the PDC rostriform compact to prevent brittle failure due to stress imbalance in a cutting process, so that the service life of the PDC rostriform compact is prolonged.

Further, the PDC rostriform compact is further provided with a third surface away from the second surface and a fourth surface at the lowest end; the third surface and the fourth surface are arranged in an intersecting manner; each of the third surface and the fourth surface is of a cone-shaped streamline structure, and the cone-shaped streamline structure is arranged to optimize a stress mode and a cutting area of the teeth during rock breaking; the third surface is provided with a first curve, a second curve, a third curve, a first ridge line, a second ridge line, a cutting edge I, and a cutting edge II, and the fourth surface is provided with a cutting edge III, a transition curve, tangent planes, a fourth curve, and a fifth curve.

Further, an included angle between the first ridge line and an axis of the PDC rostriform compact is 90°, a chip guide surface I is formed between the first ridge line and the second curve, and the chip guide surface I is of a curved surface structure; the second ridge line is a curve, one end of the second ridge line is tangential to the first ridge line, one end of the second ridge line extends downwards and intersects with the fifth curve, a chip guide surface II is formed between the second ridge line and the first curve, and the chip guide surface II is of a curved surface structure; an upper end point and a lower end point are on the second ridge line, a horizontal separation distance between the upper end point and the lower end point is 2 mm, the chip guide surface I and the chip guide surface II are smoothly tangential, and the chip guide surface I and the chip guide surface II are symmetrically distributed at both sides of the PDC rostriform compact along the cutting edge I and the cutting edge II; a right end of the fourth curve is tangential to a cylindrical surface, a left end of the fourth curve intersects with the fifth curve, and the transition curve is formed by the fourth curve rotating around a center of the cylinder; the fifth curve is located at the lowest end of the PDC rostriform compact, the fifth curve protrudes the cylinder by 3 mm, the tangent planes are tangential to the cylindrical surface and the fifth curve, and the tangent planes are symmetrically distributed along the fifth curve; the cutting edge II and the cutting edge III intersect under a drilling pressure to form a pointed cone penetrating into rocks first; the drill bit rotates to drive the rostriform PDC primary teeth to rotate; the cutting edge II and the cutting edge III cuts the rocks in the circumferential direction; the concave curved chip guide surface I and chip guide surface II wipe out the cut rocks, rock chips are overturned continuously to be broken, and finally, a drilling fluid carries the overturned and broken rocks to leave a rock breaking area.

Further, the PDC primary tooth includes a PDC primary tooth three-cutting edge compact and a semi-spherical alloy base, a triangular matching groove I for preventing fall and slippage is arranged between the PDC primary tooth three-cutting edge compact and the semi-spherical alloy base, and the PDC primary tooth three-cutting edge compact and the semi-spherical alloy base are connected by way of sintering; and the PDC secondary tooth includes a PDC secondary tooth three-cutting edge compact and a cylindrical alloy base, a triangular matching groove II for preventing fall and slippage is arranged between the PDC secondary tooth three-cutting edge compact and the cylindrical alloy base, and the PDC secondary tooth three-cutting edge compact and the cylindrical alloy base are connected by way of sintering.

Further, the water hole channels are uniformly arranged in the chip space, each of the water hole channels includes primary water holes and secondary water holes, the diameter of the primary water holes is 28 mm, there are three primary water holes, the diameter of the secondary water holes is 24 mm, and there are nine secondary water holes; and the primary water holes are distributed at the center of the drill matrix, and the secondary water holes are distributed at the edge of the drill matrix.

Based on the above technical solution, the present invention may generate the following technical effects:

1. The design of the novel rostriform PDC primary teeth. By arranging the rostriform PDC primary teeth with the rostriform cutting edges and the chip guide surface, compared with the conventional PDC teeth which cut and shear rocks, the rostriform PDC primary teeth convert the PDC tooth rock breaking mode fundamentally, so that the torque needed by the drill bit is reduced greatly, and the rock breaking efficiency of the teeth is improved.

2. Bade design and layout. By designing the nine blades, the blades are uniformly distributed at an interval of 40° in the circumferential direction of the drill matrix on the drill matrix. The design of the nine blades balances force distribution between rocks and blades at a shaft bottom, so that the abrasion loss of the teeth within a unit time is reduced, the wear resistance and collision resistance of the drill bit are improved, and the service life of the drill bit is prolonged.

3. Optimization and layout of the tooth form. High quality three-cutting edge PDC teeth, hard alloy plane teeth and reverse tapered teeth are arranged in a hybrid manner according to characteristics of the teeth. The rostriform PDC primary teeth on the blades are placed on difference circumferences, and teeth of the primary blades, the secondary blades, and the short blades are arranged in a staggered manner, so that the rostriform PDC primary teeth are uniformly distributed, and thus, the utilization ratio of the rostriform PDC primary teeth is improved, and the cutting and rock breaking efficiency of the drill bit is improved.

4. Design of height differences and tine angles of the teeth. The height difference is arranged between the teeth in front and back rows, the height difference is also arranged between the teeth in the same row, and the height differences are 0.5-1 mm. The height differences of 0.5-1 mm are arranged, so that the total rock breaking quantity per revolution is small, the torque needed by the drill bit is small, and therefore, the probability that the teeth are disintegrated is reduced. The tine angles between the teeth placed in the front and back rows and the stratum are 8-10°. Small tine angles are selected, so that the depth of the teeth penetrating into the rocks is small, and therefore, the one-time cutting output of the rocks is reduced, and the risk of tooth disintegration is further reduced.

Figure 1:
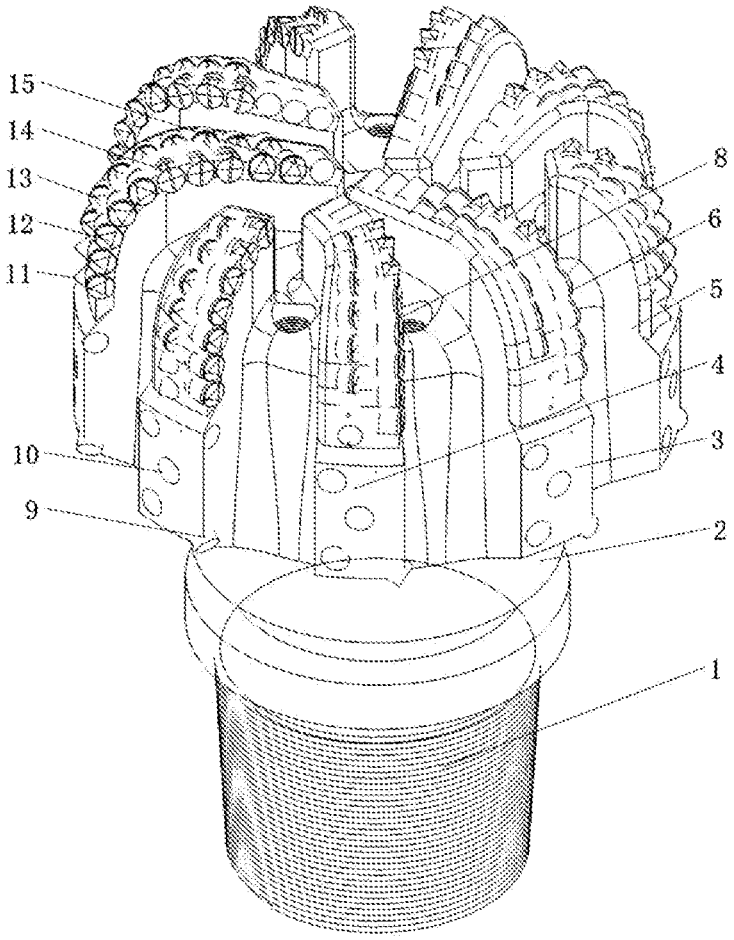
FIG. 1 is a schematic diagram of an overall structure of the present invention.

In the drawings: 1—upper joint; 2—drill matrix; 3—primary blade; 4—secondary blade; 5—short blade; 6—chip space; 7—drilling fluid flow channel; 8—water hole channel; 9—anti-jamming tooth; 10—gauge tooth; 11—reverse tapered tooth; 12—PDC primary tooth; 13—PDC secondary tooth; 14—rostriform PDC primary tooth; 15—alloy tooth; 16—first cutting area; 17—second cutting area; 18—third cutting area; 101—PDC rostriform compact; 102—spherocylindrical alloy base; 103—first surface; 104—second surface; 105—fourth surface; 106—third surface; 107—first curve; 108—second curve; 109—third curve; 110—first ridge line; 111—second ridge line; 112—chip guide surface I; 113—cutting edge I; 114—chip guide surface II; 115—cutting edge II; 116—upper end point; 117—lower end point; 118—cutting edge III; 119—transition curve; 120—tangent plane; 121—fourth curve; 122—fifth curve; 201—PDC primary tooth three-cutting edge compact; 202—semi-spherical alloy base; 203—triangular matching groove I; 301—PDC secondary tooth three-cutting edge compact; 302—cylindrical alloy base; 303—triangular matching groove II; 401—primary water hole; 402—secondary water hole.

DESCRIPTION OF THE EMBODIMENTS

In order to better understand the object, structure and function of the present invention, a novel wear-resistant and collision-resistant polycrystalline diamond compact (PDC) drill bit with rostriform teeth and a plurality of blades of the present disclosure is further described in detail below in combination with the drawings.

It is to be noted that in the description of the present invention, orientation or position relations indicated by terms "center", "longitudinal", "transverse", "upper", "lower". "front", "back", "left", "right", "vertical", "horizontal", "top", "bottom", "inner" and "outer" are orientation or position relations based on the drawings and are only used for convenient description of the present invention and simplification of the description rather than indicates or implies that the indicated devices or components must have specific orientations and are configured and operated in the specific orientations. Therefore, it cannot be construed as limitations to the present invention. In addition, the terms "first", "second" and "third" are merely used for a description purpose, and shall not be understood as indication or implication of relative importance.

As shown in FIG. 1, a novel wear-resistant and collision-resistant polycrystalline diamond compact (PDC) drill bit with rostriform teeth and a plurality of blades provided by the present invention includes an upper joint 1, a drill matrix 2, primary blades 3, secondary blades 4, and short blades 5, where the upper joint 1 is connected to the drill matrix 2 through threads; the drill matrix 2 is provided with the plurality of primary blades 3, secondary blades 4, and short blades 5; the plurality of primary blades 3, secondary blades 4, and short blades 5 are uniformly arranged at an interval of 40° in a circumferential direction on the drill matrix 2; a plurality of cutting tooth structures are arranged on the primary blades 3, secondary blades 4, and short blades 5; each of the primary blades 3 is of a linear structure, and the primary blade 3 is perpendicular to a normal plane of the drill matrix 2; each of the secondary blades 4 and short blades 5 is of a microspiral structure; a chip space 6 is arranged between adjacent blades of the drill matrix 2; and the drill matrix 2 is internally provided with a drilling fluid flow channel 7 and water hole channels 8.

The primary blades 3 play a major cutting role, the secondary blades 4 and the short blades 5 play roles of enhancing the tooth distribution density of the drill bit, optimizing the tooth distribution positions, and assisting the primary blades 3 to break the rocks, the primary blades 3, the secondary blades 4, and the short blades 5 each are provided with various types of drill bit teeth, and the drill bit teeth are match one another, so that the cutting efficiency is improved; in a specific embodiment of the present application, there are three primary blades 3, secondary blades 4, and short blades 5, respectively, and they are uniformly arranged at an interval of 40° in the circumferential direction of the drill matrix 2 on the drill matrix 2 and are distributed in central symmetry; the primary blades 3 have the longest blade length from a center line to the outermost end of the drill matrix 2, and are responsible for crushing the rocks on a projective plane of the horizontal lane of the whole drill bit, the secondary blades 4 assist the primary blades to crush the rocks out of the center area of the drill bit, and the short blades 5 assist the primary blades 3 to crush the rocks in an area in contact with the formation earliest. Specifically, the design of the nine blades on the drill matrix 2 increases the contact area between the drill bit and the rock stratum to prevent angle inclination due to stress imbalance when the drill bit collides with the shaft bottom, thereby balancing force distribution between rocks and blades at a shaft bottom, reducing the abrasion loss of the teeth within a unit time, improving the wear resistance and collision resistance of the drill bit, and prolonging the service life of the drill bit.

In the embodiment, the height difference is arranged between the teeth in the front and back rows of the second cutting area 17, and the height difference is also arranged between the teeth in the same row. The height differences are 0.5-1 mm. The height differences of 0.5-1 mm are arranged, so that the total rock breaking quantity per revolution is small, the torque needed by the drill bit is small. During operation, the torque is inputted more stably, and the teeth are hardly disintegrated because the cutting stress with the rocks at the shaft bottom is small. The tine angles between the teeth placed in the front and back rows and the stratum are 8-10°. Small tine angles are designed, so that the depth of the teeth penetrating into the rocks is small, and therefore, the one-time cutting output of the rocks is reduced, and the risk of tooth disintegration is further reduced.

Corresponding height differences can be selected according to hardness levels of the rocks. When a firm or hard rock stratum such as a granite, quartz porphyry, siliceous schist, a limestone, a sandstone, a quartz mine, griotte, dolomite, and pyrite is drilled, the height difference between the teeth is 0.5 mm; when a medium firm rock stratum such as a muddy shale and a compact marlstone is drilled, the height difference between the teeth is 0.7 mm; and when softer and soft rock strata such as gravel soil, a crushed shale, caked gravels, macadam, firm coal, and hardened clay are drilled, the height difference between the teeth is 1 mm.

The structure of each of the primary blades 3, the secondary blades 4, and the short blades 5 is divided into the gauge protection end and the cutting blade, the gauge protection end is arranged at the lower end of the cutting blade, and the gauge protection end is an end close to the upper joint 1, so that in the drilling process of the drill bit, the diameter of the boreholes is fixed and the shaft wall is round, and jamming of the drill bit taken out is prevented. The cutting blade is used for place various types of drill bit teeth for directly cutting the rocks in the stratum. The gauge protection end is provided with an anti-jamming tooth 9 and a gauge tooth 10, and a revere tapered tooth 11, a PDC primary tooth 12, a PDC secondary tooth 13, a rostriform PDC primary tooth 14, and an alloy tooth 15 are distributed at the cutting blade of the primary blade 3; and a tapered tooth 11, a PDC primary tooth 12, a PDC secondary tooth 13, and a rostriform PDC primary tooth 14 are distributed at the cutting blade 5 of the secondary blade 4 and the short blade 5.

Figure 3:
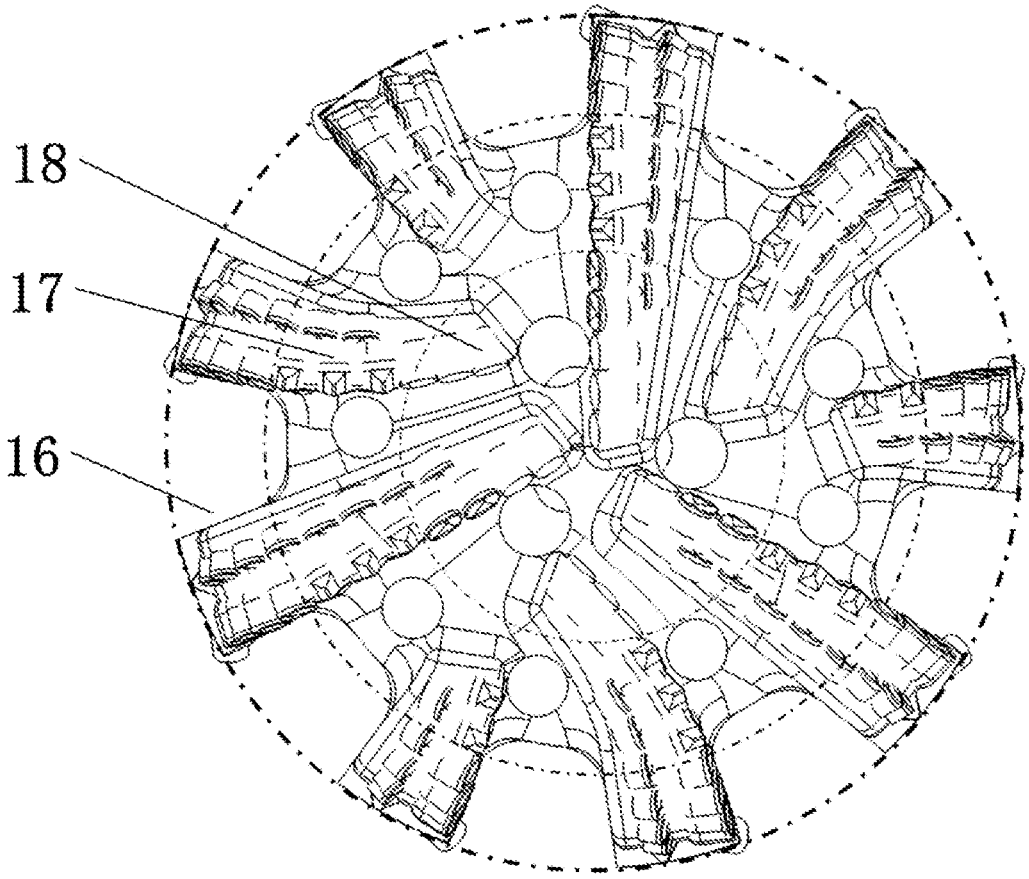
FIG. 3 is a sectional view of the present invention.

As shown in FIG. 3, a drill bit rock breaking area of the drill matrix 2 is divided into a first cutting area 16, a second cutting area 17, and a third cutting area 18; the drill matrix 2 includes the first cutting area 16, the second cutting area 17, and the third cutting area 18 in sequence from an edge to a center; the reverse tapered tooth 11, the PDC primary tooth 12, and the PDC secondary tooth 13 are placed in the first cutting area (16); the rostriform PDC primary tooth 14 and the PDC secondary tooth 13 are placed in the second cutting area 17; and the PDC primary tooth 12 and the alloy tooth 15 are placed in the third cutting area 18.

There are 3 rostriform PDC primary teeth 14 placed in the second cutting area 17 of the primary blades 3 and the secondary blades 4. There are 2 rostriform PDC primary teeth 14 placed in the second cutting area 17 of the short blades 5. The rostriform PDC primary teeth 14 are arranged in the front row of the second cutting area 17, and the PDC secondary teeth 13 are arranged in the back row thereof. The PDC secondary teeth 13 are placed between adjacent rostriform PDC primary teeth 14. After the rostriform PDC primary teeth 14 in the front row penetrate, break and cut the rocks, the PDC secondary teeth 13 in the back row cut the rocks in the gaps of the rostriform PDC primary teeth 14 in the front row. The teeth are distributed according to characteristics of the teeth, so that the utilization ratio of the teeth is improved, and the overall rock breaking efficiency of the drill bit is improved.

The drill matrix 2 is of the nine-blade structure; the rostriform PDC primary teeth 14 of the nine-blade structure are placed in different circumferences, and the rostriform PDC primary teeth 14 among the primary blades 3, secondary blades 4, and short blades 5 are distributed in a staggered manner, so that the rostriform PDC primary teeth 14 in the second cutting area 17 are uniformly distributed, thereby increasing the utilization ratio of the rostriform PDC primary teeth 14 and improving the rock breaking efficiency of the drill bit; the height difference is arranged between the teeth in front and back rows of the second cutting area 17, the height difference is also arranged between the teeth in the same row, the height differences are 0.5-1 mm, and tine angles between the teeth placed in the front and back rows and the stratum are 8-10°.

Figure 4:
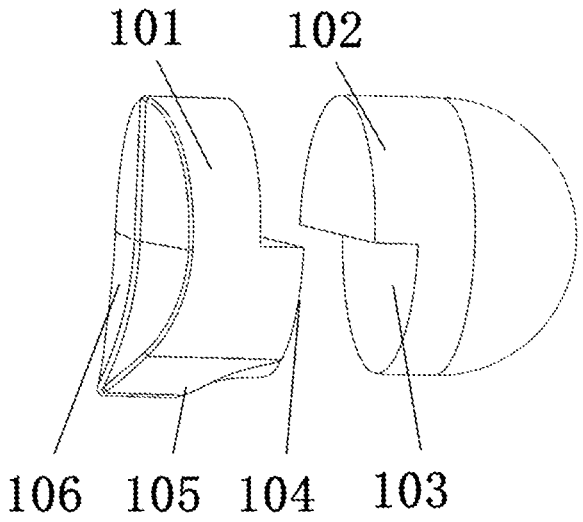
FIG. 4 is a structural schematic diagram of a rostriform PDC primary tooth of the present invention.

As shown in FIG. 4, it can be known from the shape of a beak in the biological world and its stress analysis that the rostriform structure has the advantages of small stress and high rock breaking efficiency when the drill bit breaks the rocks, so that the novel rostriform PDC primary teeth 14 are designed. The rostriform PDC primary tooth 14 includes a PDC rostriform compact 101 and a sphero-cylindrical alloy base 102, the PDC rostriform compact 101 is of a cylindrical rostriform structure, and the sphero-cylindrical alloy base 102 is of a cylindrical semi-spherical structure; one end of the sphero-cylindrical alloy base 102 is provided with a stepped first surface 103, the PDC rostriform compact 101 is provided with a stepped second surface 104 contrary to the first surface 103, and the second surface 104 is matched with the first surface 103. The PDC rostriform compact 101 is designed slightly on the upper side and narrow on the lower side.

Figure 5:
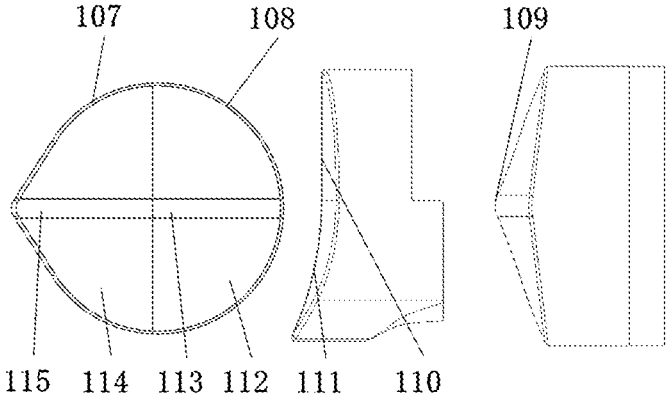
FIG. 5 is three views of the PDC rostriform compact of the present invention.
Figure 6:
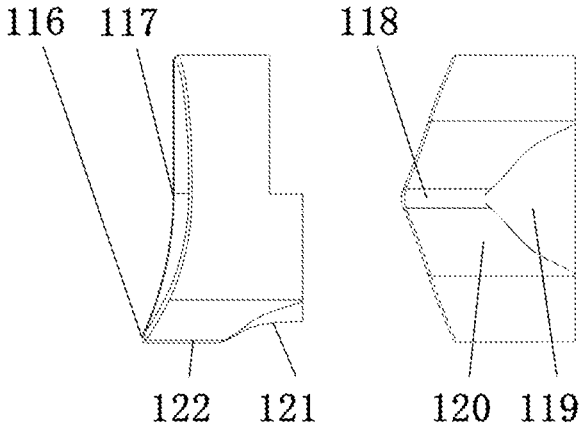
FIG. 6 is partial schematic diagrams of a top view and a bottom view of the PDC rostriform compact of the present invention.

As shown in FIGS. 5-6, the PDC rostriform compact 101 is further provided with a third surface 106 away from the second surface 104 and the lowest fourth surface 105; the third surface 106 is provided with a first curve 107, a second curve 108, a third curve 109, a first ridge line 110, a second ridge line 111, a cutting edge I 113, and a cutting edge II 115; the fourth surface 105 is provided with a cutting edge III 118, a transition curve 119, tangent planes 120, a fourth curve 121, and a fifth curve 122; an included angle between the first ridge line 110 and an axis of the PDC rostriform compact 101 is 90°, a chip guide surface I 112 is formed between the first ridge line 110 and the second curve 108, and the chip guide surface I 112 is of a curved surface structure; the second ridge line 111 is a curve, one end of the second ridge line 111 is tangential to the first ridge line 110, one end of the second ridge line 111 extends downwards and intersects with the fifth curve 122, a chip guide surface II 114 is formed between the second ridge line 111 and the first curve 107, and the chip guide surface II 114 is of a curved surface structure; an upper end point 116 and a lower end point 117 are on the second ridge line 111, a horizontal separation distance between the upper end point 116 and the lower end point 117 is 2 mm, the chip guide surface I 112 and the chip guide surface II 114 are smoothly tangential, and the chip guide surface I 112 and the chip guide surface II 114 are symmetrically distributed at both sides of the PDC rostriform compact 101 along the cutting edge I 113 and the cutting edge II 115; a right end of the fourth curve 116 is tangential to a cylindrical surface, a left end of the fourth curve 116 intersects with the fifth curve 122, and the transition curve 119 is formed by the fourth curve 116 rotating around a center of the cylinder; the fifth curve 122 is located at the lowest end of the PDC rostriform compact 101, the fifth curve 122 protrudes the cylinder by 3 mm, the tangent planes 119 are tangential to the cylindrical surface and the fifth curve 122, and the tangent planes 119 are symmetrically distributed along the fifth curve 122.

The alloy teeth 15, the PDC primary teeth 12, the rostriform PDC primary teeth 14, the PDC secondary teeth 13, and the reverse tapered teeth 11 are respectively distributed on the primary blade 3 from the center to the edge of the drill matrix 2, and the quantities of the teeth are as follows: 2 reverse tapered teeth 11, 7 PDC primary teeth 12, 8 PDC secondary teeth 13, 3 rostriform PDC primary teeth 14, and 1-3 alloy teeth 15.

The PDC primary teeth 12, the rostriform PDC primary teeth 14, the PDC secondary teeth 13, and the reverse tapered teeth 11 are respectively distributed on the secondary blade 4 from the center to the edge of the drill matrix 2, and the quantities of the teeth are as follows: 3 rostriform PDC primary teeth 14, 5 PDC primary teeth 12, 6 PDC secondary teeth 13, 2 reverse tapered teeth 11, and 3 alloy teeth 15.

The rostriform PDC primary teeth 14, the PDC primary teeth 12, the PDC secondary teeth 13, and the reverse tapered teeth 11 are respectively distributed on the short blade 5 from the center to the edge of the drill matrix 2, and the quantities of the teeth are as follows: 2 rostriform PDC primary teeth 14, 5 PDC primary teeth 12, 5 PDC secondary teeth 13, and 2 reverse tapered teeth 11.

The quantities and combinations of the teeth on the primary blades 3, the second blades 4, and the short blades 5 can be freely combined according to characteristics of the strata and field construction requirements, so that the mechanical drilling rate of the drill bit is improved, and the service life of the drill bit is prolonged.

Figure 7:
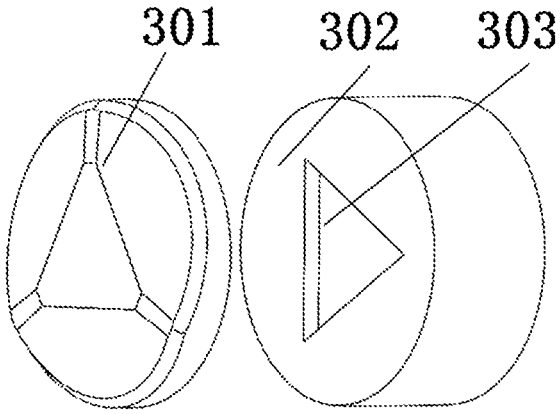
FIG. 7 is a structural schematic diagram of the PDC primary tooth of the present invention.

As shown in FIG. 7, the PDC primary tooth 12 includes a PDC primary tooth three-cutting edge compact 201 and a semi-spherical alloy base 202, a triangular matching groove I 203 for preventing fall and slippage is arranged between the PDC primary tooth three-cutting edge compact 201 and the semi-spherical alloy base 202, and the PDC primary tooth three-cutting edge compact 201 and the semi-spherical alloy base 202 are connected by way of sintering.

Figure 8:
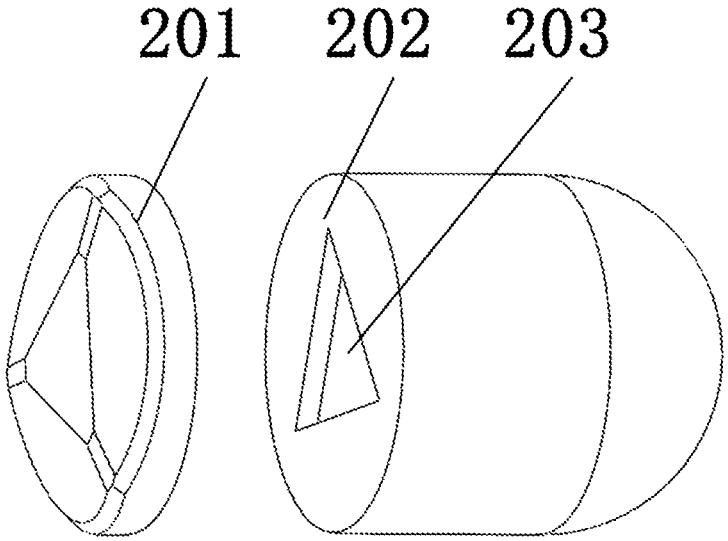
FIG. 8 is a structural schematic diagram of a PDC secondary tooth of the present invention.

As shown in FIG. 8, the PDC secondary tooth 13 includes a PDC secondary tooth three-cutting edge compact 301 and a cylindrical alloy base 302, a triangular matching groove II 303 for preventing fall and slippage is arranged between the PDC secondary tooth three-cutting edge compact 301 and the cylindrical alloy base 302, and the PDC secondary tooth three-cutting edge compact 301 and the cylindrical alloy base 302 are connected by way of sintering.

Figure 2:
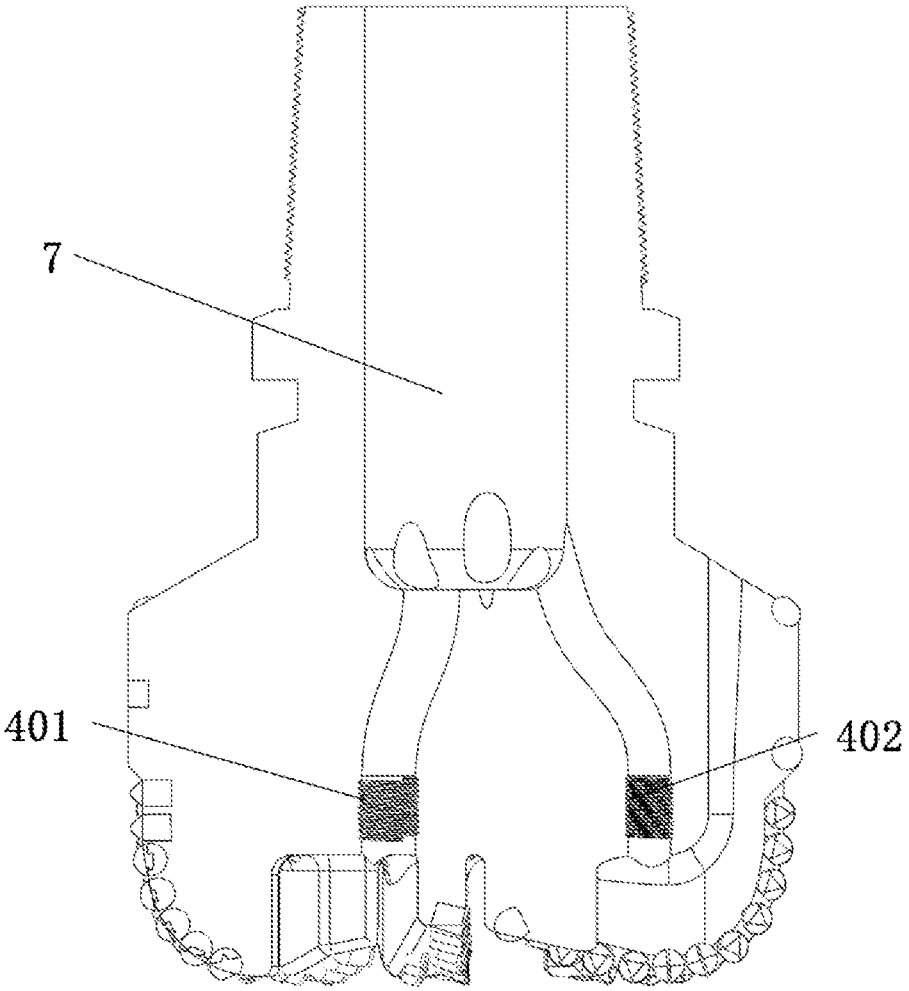
FIG. 2 is a top view of a structure of the present invention.

As shown in FIG. 2, the water hole channels 8 are uniformly arranged in the chip space 6, each of the water hole channels 8 includes primary water holes 401 and secondary water holes 402, the diameter of the primary water holes 401 is 28 mm, there are three primary water holes, the diameter of the secondary water holes 402 is 24 mm, and there are nine secondary water holes; and the primary water holes 401 are distributed at the center of the drill matrix 2, and the secondary water holes 402 are distributed at the edge of the drill matrix 2.

Specifically, the rock breaking mechanism of the rostriform PDC primary tooth 14 is as follows: after the rostriform PDC primary tooth 14 contacts with the stratum and the rostriform PDC primary tooth at the lowest end of the drill bit contacts with the stratum, the pointed cone formed by intersecting the cutting edge II 115 and the cutting edge III 118 under a drilling pressure penetrates into the rock first, the drill bit rotates to drive the rostriform PDC primary tooth to rotate, and in this case, the cutting edge II 115 and the cutting edge III 118 cut the rocks out in the circumferential direction. The concave curve chip guide surface I 112 and chip guide surface II 114 wipe out the cut rocks, rock debris is overturned continuously to be broken, and finally, a drilling fluid carries the overturned and broken rocks to leave a rock breaking area. Compared with the conventional PDC teeth shearing and scratching the rocks, the rostriform PDC primary teeth 14 transform the PDC tooth rock breaking mode fundamentally, so that the torque needed by the drill bit is greatly reduced, and the rock breaking efficiency of the teeth is improved. The conventional PDC tooth breaking mode is primarily based on cutting, shearing and destructing assisted with extruding and damaging. The cutting edges of the teeth contact with the stratum to forcibly cut the rocks, and as a result, the force on the teeth is great, the torque needed by the drill bit is large, the teeth are easily disintegrated, and the service life of the drill bit is short. The rostriform PDC primary teeth 14 transform the PDC tooth rock breaking mode fundamentally. Primarily based on penetrating, splitting and cutting assisted with breaking the surface at the point, the torque needed by the drill bit is greatly reduced, so that the teeth are protected.

It can be understood that the present invention is described by means of some examples. As those skilled in the art know, various changes or equivalent replacements can be made to the features and examples without departing from the spirit and scope of the present invention. In addition, with the teachings of the present invention, the features and examples can be modified to be adapted to specific situations and materials without departing from the spirit and scope of the present invention. Therefore, the present invention is not limited by the specific examples disclosed herein, and all the examples falling within the scope of the claims of the present disclosure fall within the scope of protection of the present invention.

What is claimed is:

1. A novel wear-resistant and collision-resistant polycrystalline diamond compact (PDC) drill bit with rostriform teeth and a plurality of blades, comprising an upper joint (1), a drill matrix (2), primary blades (3), secondary blades (4), and short blades (5), wherein the upper joint (1) is connected to the drill matrix (2) through threads; the drill matrix (2) is of a nine-blade structure; the plurality of primary blades (3), secondary blades (4), and short blades (5) are uniformly distributed on the drill matrix (2); the plurality of primary blades (3), secondary blades (4), and short blades (5) are uniformly arranged at an interval of 40° in a circumferential direction on the drill matrix (2); a plurality of cutting tooth structures are arranged on the primary blades (3), secondary blades (4), and short blades (5); each of the primary blades (3) is of a linear structure, and the primary blade (3) is perpendicular to a normal plane of the drill matrix (2); each of the secondary blades (4) and short blades (5) is of a spiral structure; a chip space (6) is arranged between adjacent blades of the drill matrix (2); and the drill matrix (2) is internally provided with a drilling fluid flow channel (7) and water hole channels (8); the rostriform PDC primary teeth (14) of the nine-blade structure are placed in different circumferences, and the rostriform PDC primary teeth (14) among the primary blades (3), secondary blades (4), and short blades (5) are distributed in a staggered manner, so that the rostriform PDC primary teeth (14) in a second cutting area (17) are uniformly distributed, thereby increasing a utilization ratio of the rostriform PDC primary teeth (14) and improving the rock breaking efficiency of the drill bit; a first height difference is arranged between the teeth in front and back rows of the second cutting area (17), a second height difference is also arranged between the teeth in the same row, the first and the second height differences are 0.5-1 mm, and tine angles between the teeth placed in the front and back rows and the stratum are 8-10°; and a one-time penetration of the drill bit is reduced by arranging the first and the second height differences and tine angles to prevent the teeth from being disintegrated and falling off, so that the service life of the drill bit is prolonged; wherein the rostriform PDC primary tooth (14) comprises a PDC rostriform compact (101) and a sphero-cylindrical alloy base (102), the PDC rostriform compact (101) is of a cylindrical rostriform structure, and the sphero-cylindrical alloy base (102) is of a cylindrical semi-spherical structure; one end of the sphero-cylindrical alloy base (102) is provided with a stepped first surface (103), the PDC rostriform compact (101) is provided with a stepped second surface (104) contrary to the first surface (103), and the second surface (104) is matched with the first surface (103); and a stepped design partially increases the thickness of a cutting part of the PDC rostriform compact (101) to prevent brittle failure due to stress imbalance in a cutting process, so that the service life of the PDC rostriform compact (101) is prolonged; wherein the PDC rostriform compact (101) is further provided with a third surface (106) away from the second surface (104) and a fourth surface (105) at the lowest end; the third surface (106) and the fourth surface (105) are arranged in an intersecting manner; each of the third surface (106) and the fourth surface (105) is of a cone-shaped streamline structure, and the cone-shaped streamline structure is arranged to optimize a stress mode and a cutting area of the teeth during rock breaking; the third surface (106) is provided with a first curve (107), a second curve (108), a third curve (109), a first ridge line (110), a second ridge line (111), a cutting edge I (113), and a cutting edge II (115), and the fourth surface (105) is provided with a cutting edge III (118), a transition curve (119), tangent planes (120), a fourth curve (121), and a fifth curve (122).

2. The novel wear-resistant and collision-resistant PDC drill bit with rostriform teeth and the plurality of blades according to claim 1, wherein the structure of each of the primary blades (3), secondary blades (4), and short blades (5) is divided into a gauge protection end and a cutting blade; the gauge protection end is provided with an anti-jamming tooth (9) the gauge protection end is arranged at an upper end of the cutting blade and is an end close to the upper joint (1); and the cutting blade of the drill bit is divided into a first cutting area (16), the second cutting area (17), and a third cutting area (18); the drill matrix (2) comprises the first cutting area (16), the second cutting area (17), and the third cutting area (18) in sequence from an edge to a center; the first cutting area (16) is responsible for breaking rocks at the center of the drill bit, and a reverse tapered tooth (11), a PDC primary tooth (12), and a PDC secondary tooth (13) are placed in the first cutting area; the second cutting area (17) is a major cutting area of the drill bit and is responsible for drilling and breaking new rock strata, and a rostriform PDC primary tooth (14) and a PDC secondary tooth (13) are placed in the second cutting area; and the third cutting area (18) is a diameter expanding area responsible for expanding the diameter of a borehole, and a PDC primary tooth (12) and an alloy tooth (15) are placed in the third cutting area.

3. The novel wear-resistant and collision-resistant PDC drill bit with rostriform teeth and the plurality of blades according to claim 1, wherein an included angle between the first ridge line (110) and an axis of the PDC rostriform compact (101) is 90°, a chip guide surface I (112) is formed between the first ridge line (110) and the second curve (108), and the chip guide surface I (112) is of a curved surface structure; the second ridge line (111) is a curve, one end of the second ridge line (111) is tangential to the first ridge line (110), one end of the second ridge line (111) extends downwards and intersects with the fifth curve (122), a chip guide surface II (114) is formed between the second ridge line (111) and the first curve (107), and the chip guide surface II (114) is of a curved surface structure; an upper end point (116) and a lower end point (117) are on the second ridge line (111), a horizontal separation distance between the upper end point (116) and the lower end point (117) is 2 mm, the chip guide surface I (112) and the chip guide surface II (114) are smoothly tangential, and the chip guide surface I (112) and the chip guide surface II (114) are symmetrically distributed at both sides of the PDC rostriform compact (101) along the cutting edge I (113) and the cutting edge II (115); a right end of the fourth curve (121) is tangential to a cylindrical surface, a left end of the fourth curve (121) intersects with the fifth curve (122), and the transition curve (119) is formed by the fourth curve (121) rotating around a center of the cylinder; the fifth curve (122) is located at the lowest end of the PDC rostriform compact (101), the fifth curve (122) protrudes the cylinder by 3 mm, the tangent planes (120) are tangential to the cylindrical surface and the fifth curve (122), and the tangent planes (120) are symmetrically distributed along the fifth curve (122); the cutting edge II (115) and the cutting edge III (118) intersect under a drilling pressure to form a pointed cone penetrating into rocks first; the drill bit rotates to drive the rostriform PDC primary teeth (12) to rotate; the cutting edge II (115) and the cutting edge III (118) cut the rocks in the circumferential direction; the concave curved chip guide surface I (112) and chip guide surface II (114) wipe out the cut rocks, rock chips are overturned continuously to be broken, and finally, a drilling fluid carries the overturned and broken rocks to leave a rock breaking area.

4. The novel wear-resistant and collision-resistant PDC drill bit with rostriform teeth and the plurality of blades according to claim 2, wherein the PDC primary tooth (12) comprises a PDC primary tooth three-cutting edge compact (201) and a semi-spherical alloy base (202), a triangular matching groove I (203) for preventing fall and slippage is arranged between the PDC primary tooth three-cutting edge compact (201) and the semi-spherical alloy base (202), and the PDC primary tooth three-cutting edge compact (201) and the semi-spherical alloy base (202) are connected by way of sintering; and the PDC secondary tooth (13) comprises a PDC secondary tooth three-cutting edge compact (301) and a cylindrical alloy base (302), a triangular matching groove II (303) for preventing fall and slippage is arranged between the PDC secondary tooth three-cutting edge compact (301) and the cylindrical alloy base (302), and the PDC secondary tooth three-cutting edge compact (301) and the cylindrical alloy base (302) are connected by way of sintering.

5. The novel wear-resistant and collision-resistant PDC drill bit with rostriform teeth and the plurality of blades according to claim 1, wherein the water hole channels (8) are uniformly arranged in the chip space (6), each of the water hole channels (8) comprises primary water holes (401) and secondary water holes (402), the diameter of the primary water holes (401) is 28 mm, there are three primary water holes, the diameter of the secondary water holes (402) is 24 mm, and there are nine secondary water holes; and the primary water holes (401) are distributed at the center of the drill matrix (2), and the secondary water holes (402) are distributed at the edge of the drill matrix (2).

* * * * *